United States Patent [19]

Hayashi et al.

[11] 4,033,309

[45] July 5, 1977

[54] EXHAUST GAS RECIRCULATION SYSTEM WITH CONTROL APPARATUS FOR EXHAUST GAS FLOW CONTROL VALVE

[75] Inventors: Yoshimasa Hayashi, Yokohama; Yasuo Nakajima, Yokosuka; Kunihiko Sugihara; Shin-ichi Nagumo, both of Yokohama, all of Japan

[73] Assignee: Nissan Motor Co., Ltd., Japan

[22] Filed: June 19, 1975

[21] Appl. No.: 588,240

[30] Foreign Application Priority Data

June 24, 1974 Japan ..... 49-72084

[52] U.S. Cl. ..... 123/119 A

[51] Int. Cl.[2] ..... F02M 25/06

[58] Field of Search ..... 123/119 A

[56] References Cited

UNITED STATES PATENTS

| | | | |
|---|---|---|---|
| 3,739,797 | 6/1973 | Caldwell | 123/119 A |
| 3,774,583 | 11/1973 | King | 123/119 A |
| 3,796,049 | 3/1974 | Hayashi | 123/119 A |
| 3,814,070 | 6/1974 | Wertheimer | 123/119 A |
| 3,818,880 | 6/1974 | Dawson et al. | 123/119 A |
| 3,877,452 | 4/1975 | Nohira et al. | 123/119 A |
| 3,896,777 | 7/1975 | Masaki et al. | 123/119 A |
| 3,915,136 | 10/1975 | Caldwell | 123/119 A |
| 3,924,589 | 12/1975 | Nohira et al. | 123/119 A |
| 3,926,161 | 12/1975 | Wertheimer | 123/119 A |

*Primary Examiner*—C. J. Husar
*Assistant Examiner*—David D. Reynolds
*Attorney, Agent, or Firm*—Robert E. Burns; Emmanuel J. Lobato; Bruce L. Adams

[57] ABSTRACT

An exhaust gas recirculation system comprises an exhaust gas flow control valve; a vacuum actuator for operation of the flow control valve; and a control apparatus constructed and arranged such that an output vacuum of the control apparatus applied to the vacuum actuator is an amplification of the venturi vacuum modified by the intake manifold vacuum.

7 Claims, 1 Drawing Figure

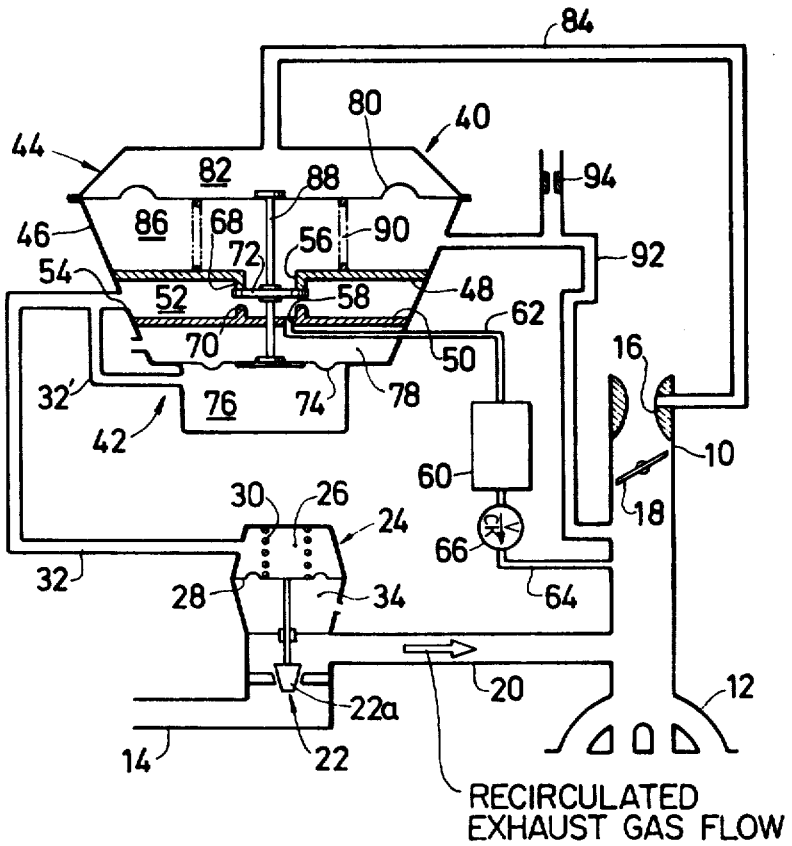
84
80
40
44
82
88
94
46
86
68
56
90
92
54
72
52
58
48
62
70
50
16
32'
76
74
78
42
10
60
30
26
24
18
66
32
28
34
64
20
12
22a
14
22
RECIRCULATED
EXHAUST GAS FLOW

EXHAUST GAS RECIRCULATION SYSTEM WITH CONTROL APPARATUS FOR EXHAUST GAS FLOW CONTROL VALVE

BACKGROUND OF THE INVENTION

The present invention relates to an exhaust gas recirculation system in an internal combustion engine, and more particularly to a control apparatus for an exhaust gas flow control valve of exhaust gas recirculation system.

Heretofore, there have been many proposals to introduce, throughout all operating conditions of an internal combustion engine, a substantially inert gas such as exhaust gas into the intake system; i.e. into the intake manifold or into the induction passage at a location downstream of the air filter; with the intention of reducing the concentration of nitrogen oxides ($No_x$) in the engine exhaust gases by suppressing their formation. It is required that a suitable amount of exhaust gas be introduced into the intake system of the engine to attain satisfactory results. A reduction in engine performance results if the ratio of the flow rate of recirculated exhaust gas to that of intake air exceeds a certain optimum value, and failure to suppress the formation of nitrogen oxides results if the ratio is much smaller than the certain optimum value. If intake manifold vacuum is employed to actuate a valve for controlling the flow of exhaust gas into the intake system of the engine, as is common in the prior art, it is hardly possible to maintain the flow rate ratio of recirculated exhaust gas to intake air at an optimum value mostly due to the fact that the vacuum in the intake manifold does not vary in proportion to the intake air flow rate throughout operation of the engine.

It has been confirmed that the vacuum in the venturi of a carburetor varies in relation to the velocity of air flowing through the venturi throughout operation of the engine, and therefore in relation to the flow rate of intake air being introduced into the engine. Thus, if the vacuum in the venturi is employed as a variable in controlling the amount of exhaust gas introduced into the intake system, the flow rate of exhaust gas can be metered to an optimum ratio to that of intake air throughout all modes of operation of the engine. However, the vacuum in the venturi is not strong enough for adequate control of a vacuum actuated valve to meter the flow rate of recirculated exhaust gas.

Conventionally, an exhaust gas recirculation system has a control apparatus providing a vacuum output which is an amplification of a vacuum in the venturi of a carburetor to a valve actuator of an exhaust gas flow control valve thereby to open an exhaust recirculation conduit responsive to changes in the venturi vacuum. When, in the conventional exhaust gas recirculation system, the intake manifold vacuum increases with the venturi vacuum remains unchanged, the flow rate ratio of recirculated exhaust gas to intake air increases above an optimum value because flow rate of the exhaust gas through the recirculation conduit increases as the intake manifold increases even if the opening degree by the flow control valve is constant. Thus with the conventional exhaust gas recirculation system it is difficult to keep the flow rate of exhaust gas to an optimum ratio to that of intake air throughout all modes of operation of the engine. It is desirable that the opening degree of the flow control valve be decreased as the intake manifold vacuum increases or be increased as the intake manifold vacuum decreases so as to keep the flow rate ratio of recirculated exhaust gas to the venturi vacuum at an optimum value.

SUMMARY OF THE INVENTION

It is accordingly an object of the present invention to provide an exhaust gas recirculation system having a control apparatus which has a vacuum output which is an amplification of a vacuum in the venturi of a carburetor (the venturi vacuum) but modified by variation of a vacuum in the intake manifold vacuum (the intake manifold vacuum).

BRIEF DESCRIPTION OF THE DRAWING

The present invention will become clear as this description progresses with reference to the accompanying drawing in which A single FIGURE shows an exhaust gas recirculation system with a control apparatus in accordance with the present invention.

DESCRIPTION OF THE PREFERRED EMBODIMENT

Referring to the drawing, an exhaust gas recirculation system is shown as incorporated in an internal combustion engine which may be of any conventional design, being provided with a usual carburetor 10, an intake manifold 12, and an exhaust pipe 14 leading from an exhaust manifold (not shown). The carburetor 10 is provided with a venturi section 16 and a throttle flap 18.

The exhaust gas recirculation system includes an exhaust gas recirculation conduit 20 connecting the exhaust pipe 14 with the intake manifold 12 to recirculate a portion of the engine exhaust gas to the intake manifold 12. Mounted to the recirculation conduit 20 is an exhaust gas flow control valve 22 which normally closes the recirculation conduit 20. The valve 22 is urged toward its opening position by a valve actuator 24. The valve actuator 24 includes a vacuum chamber 26 and a flexible diaphragm 28 operatively connected to a valve member **22*a* to urge the valve member 22*a* against a compression spring 30 toward its opening position so as to open the recirculation conduit 20 responsive to a vacuum in the vacuum chamber 26. The vacuum chamber 26 above the diaphragm 28 is connected by a vacuum conduit 32 to a control apparatus generally designated as 40, whereas a chamber 34 beneath the diaphragm 28** is open to the atmosphere as shown.

The degree of vacuum present in the vacuum chamber 26 is controlled by the control apparatus 40 comprised of a vacuum regulator 42 and a vacuum motor 44 for actuating the regulator 42. The vacuum regulator 42 and the vacuum motor 44 are combined in a unitary structure.

The control apparatus 40 includes a housing 46 having a first partition wall 48 and a second partition wall 50 spaced in parallel from the first partition wall 48. The partition walls 48 and 50 cooperate to form in the interior of the housing 48 a vacuum regulating chamber 52 of the vacuum regulator 42. The regulating chamber 52 has an inlet port 54 connected to the vacuum chamber 26 through the vacuum conduit 32 for actuation of the diaphragm 28 by vacuum produced in the vacuum regulating chamber 52 to operate the exhaust gas flow control valve 22. The regulating chamber 52 has an air bleed port 56 and an outlet port 58 connected to a vacuum reservoir or source 60 through a vacuum conduit 62. The vacuum reservoir 60 is connected to the intake manifold 12 through a vacuum conduit 64 having a check valve 66. The air bleed port 60 is defined in a valve seat 68 projecting from the partition wall 48 inwardly of the vacuum regulating chamber 52 and the outlet port 58 is defined in a valve seat 70 projecting from the second partition wall 50 inwardly of the chamber 58. The valve seats 68 and 70 are opposed to each other and spaced a distance (the distance between the valve seats 68 and 70 shown in the drawing being exaggerated). The vacuum regulator 42 has a valve member 72 in the regulating chamber 52 and a flexible diaphragm 74. The flexible diaphragm is mounted in the housing 46, forms on one side thereof and in the housing a feed back chamber 76 communicating with the vacuum regulating chamber 52 through the inlet port 54 via a branch conduit 32', and forms on the opposite side and in the housing an atmospheric pressure chamber 78. It is seen that the second partition wall 50 and the upper side of the diaphragm 74 cooperate to form the atmospheric chamber 78.

The vacuum motor 44 for actuation of the vacuum regulator 42 has an operating flexible diaphragm 80 mounted in the housing 46 above the partition wall 48. The diaphragm 80 forms on an upper side thereof and in the housing a venturi vacuum chamber 82 communicating with the venturi section 16 through a vacuum conduit 84 and forms on the lower or opposite side thereof and in the housing 46 a biasing chamber 86 communicating with the vacuum regulating chamber 52 through the air bleed port 56. It is seen that partition wall 48 and the lower side of the diaphragm 80 cooperate to form in the housing 46 the biasing chamber 86. A rod 88 mechanically interconnects the diaphragms 74 and 80 and the valve member 72 is secured to the rod 88, such that the valve member is movable in response to deflections of the diaphragms 74 and 80 to selectively seat on the valve seat 70 thereby closing the outlet port 58 and on the valve seat 68 thereby closing the air bleed port 56 and preventing admission of air from the biasing chamber 86 into the vacuum regulating chamber 52.

When the valve member 72 is raised by the diaphragm 80 to the illustrated position in which the air bleed port 56 is closed and the outlet port 58 is opened, the vacuum conduit 62 effects communication of the vacuum regulating chamber 52 with the vacuum reservoir 60. When the valve member 72 is lowered by the diaphragm 74, the air bleed port 56 is opened, and further lowering of the valve member 72 closes the outlet port 58. The reduction of the vacuum in the feed back chamber 76 by this action tends to cause the valve member 72 and the diaphragm 74 to be moved upwardly, thereby sequentially opening the outlet port 58 and then closing the air bleed port 56, thereby connecting the vacuum regulating chamber 52 with the vacuum reservoir 60. An equilibrium is established whereby a vacuum of a predetermined value is produced in the vacuum regulating chamber 52 and the feed back chamber 76 according to an upward force applied to the valve member 72 and the diaphragm 74.

To provide a vacuum output in the vacuum regulating chamber 52 which is an amplification of the venturi vacuum in the venturi vacuum chamber 82 and acting on the upper side of the diaphragm 80, an effective area of the diaphgram 80 is formed to be considerably larger than that of the diaphragm 74 and a compression spring is compressed between the diaphragm 80 and the partition wall 48 to mechanically bias the diaphragm 80 upwardly. The biasing chamber 86 is connected with the intake manifold 12 by a vacuum conduit 92 having an air bleeder orifice 94. The air bleeder orifice 94 has a restriction chosen such that a vacuum present in the biasing chamber 86 is a reduction of a vacuum in the intake manifold 12 and is considerably lower than a vacuum in the venturi vacuum chamber 82. It will be understood that an upward force applied to the valve member 72 and the diaphragm 74 by the diaphragm due to the venturi vacuum and by the spring 90 is reduced as the intake manifold vacuum increases, thereby causing a corresponding reduction of vacuum in the vacuum regulating chamber 52. Thus it will now be appreciated that if the intake manifold vacuum increases with the venturi vacuum remained constant, the valve member 22a is caused to decrease the opening degree of the recirculation conduit 20.

Assuming now that the intake manifold vacuum is at constant level, the vacuum in the vacuum regulating chamber 52 is expressed by the following equation:

$$Pr = \frac{Sm}{Sr} Pv + F \qquad (1)$$

where:

$Pr$ is the vacuum in the vacuum regulating chamber 52;

$Pv$ is the vacuum in the venturi section 16;

$Sm$ is the effective area of the diaphragm 80 of the vacuum motor 44;

$Sr$ is the effective area of the diaphragm 74 of the vacuum regulator 42; and F is the biasing force by the compression spring 90.

From the above equation (1), it will be understood that the vacuum $Pr$ is $Sm/Sr$ times the venturi vacuum $Pv$, if $F = 0$.

Since in the control apparatus 40 a reduced intake manifold vacuum acts in the biasing chamber 86 beneath the diaphragm 80 having the effective area $Sm$, the equation (1) is now modified as follows:

$$Pr = \frac{Sm}{Sr} (Pv - Pi) + F \qquad (2)$$

where:

$Pi$ is the reduced intake manifold vacuum in the biasing chamber 86.

It will be confirmed from the equiation (2) that $Pv > Pi$ is necessary to make the control apparatus 40 operative.

It will now be understood that the vacuum $Pr$ in the vacuum regulating chamber 52 is variable only in response to the venturi vacuum $pv$ as far as the reduced manifold vacuum $Pi$ is substantially at constant level, but the vacuum $Pr$ decreases as the reduced manifold vacuum $Pi$ increases or increases as the reduced manifold vacuum $Pi$ decreases even if the venturi vacuum $Pv$ is at a constant level. It will now be appreciated that the flow rate ratio of recirculated exhaust gas to the intake air is kept at an optimum value because the opening degree of the recirculation conduit 20 is appropriately varied responsive not only to the venturi vacuum but also to the intake manifold vacuum.

What is claimed is:

1. An exhaust gas recirculating system comprising:

a recirculation conduit to recirculate a portion of exhaust gas from the exhaust system of an internal combustion engine to the intake system having a carburetor and an intake manifold;

an exhaust gas flow control valve normally closing said recirculation conduit;

a valve actuator including a vacuum chamber and a diaphragm operatively connected to said exhaust gas flow control valve to urge said exhaust gas flow control valve toward its open position so as to open said recirculation conduit responsive to a vacuum in the vacuum chamber of said valve actuator; and a control apparatus comprising:

a housing having a vacuum regulating chamber, said vacuum regulating chamber having an inlet port connected to the vacuum chamber of said valve actuator and an outlet port connected to a vacuum source;

a first diaphragm mounted in said housing, said first diaphragm forming on one side thereof and in said housing a feed back chamber communicating with said vacuum regulating chamber and forming on the opposite side thereof and in said housing an atmospheric pressure chamber;

a second diaphragm mounted in said housing, said second diaphragm forming on one side thereof and in said housing a venturi vacuum chamber communicating with the venturi of said carburetor and forming on the opposite side thereof and in said housing a biasing chamber communicable with said vacuum regulating chamber through said air bleed port;

interconnecting means mechanically interconnecting said first and second diaphragm, said interconnecting means including a valve member movable in response to deflections of said first and second diaphragms to selectively close said outlet port and said air bleed port;

an effective area of said second diaphragm being larger than that of said first diaphragm; and a vacuum conduit having an air bleeder orifice, said vacuum conduit connecting said biasing chamber with the intake manifold, said air bleeder orifice having a restriction chosen such that a vacuum present in said biasing chamber is a reduction of a vacuum in the intake manifold and is lower than a vacuum in said venturi vacuum chamber.

2. An exhaust gas recirculation system as claimed in claim 1, in which said control apparatus further comprising first and second partition walls cooperating to form in said housing said vacuum regulating chamber, said air bleed port being defined in a first valve seat projecting from said first partition wall inwardly of said regulating chamber, said outlet port being defined in a second valve seat projecting from said second partition wall inwardly of said vacuum regulating chamber, said first partition wall and said the opposite side of second diaphragm cooperating to form in said housing said biasing chamber, said second partition wall and the opposite side of said first diaphragm cooperating to form in said housing said atmospheric chamber, said first and second valve seats having disposed therebetween said valve member of said interconnecting means.

3. In an internal combustion engine having an intake passage having a venturi and a throttle valve and an exhaust passage, an exhaust gas recirculation system comprising:

a recirculation conduit to recirculate a portion of exhaust gas from the exhaust passage to the intake passage;

an exhaust gas flow control valve to control exhaust gas flow in said recirculation conduit;

a valve actuator including a pressure chamber and a diaphragm operatively connected to said exhaust gas flow control valve to operate said exhaust gas flow control valve in response to changes in pressure in said pressure chamber;

a source of pressure; and a control apparatus including a pressure responsive regulator valve fluidly intermediate said valve actuator and said source of pressure and having means movable between an open position in which said pressure chamber is permitted to communicate with said source of pressure and a closed position in which said pressure chamber is prevented from communicating with said source of pressure, means defining a port communicating with the intake passage, means fluidly connected to the venturi for moving said regulator valve toward its open position responsive to vacuum at the venturi and means fluidly connected to said port communicating with the intake passage downstream of the throttle valve for moving said regulator valve toward its closed position responsive to vacuum at said port.

4. In an internal combustion engine having an intake passage having a venturi and a throttle valve and an exhaust passage, an exhaust gas recirculation system comprising:

a recirculation conduit to recirculate a portion of exhaust gas from the exhaust passage to the intake passage;

an exhaust gas flow control valve to control exhaust gas flow in said recirculation conduit;

a valve actuator having a pressure chamber;

a source of pressure;

a control apparatus including a pressure responsive regulator valve fluidly intermediate said valve actuator and said source of pressure and having means movable between an open position in which said pressure chamber is permitted to communicate with said source of pressure and a closed position in which said pressure chamber is prevented from communicating with said source of pressure, a housing, a diaphragm in said housing to divide said housing into a first chamber and a second chamber, said first chamber communicating with the venturi, said second chamber communicating with a port opening to the intake passage downstream of the throttle valve, and a rod interconnecting said diaphragm and said regulator valve, the construction and arrangement being such that increase of vacuum at the venturi causes said regulator valve to be moved to its open position and increase of vacuum at said port causes said regulator valve to be moved to its closed position.

5. An exhaust gas recirculation system as claimed in claim 4, in which said source of pressure takes the form of a source of vacuum, said valve actuator has a diaphragm defining said pressure chamber and a rod operatively connecting the diaphragm of said valve actuator to said exhaust gas flow control valve such that increase of vacuum in said pressure chamber move said exhaust gas flow control valve to an open position, and in which said rod of said control apparatus is arranged such that increase of vacuum in the first chamber causes said regulator valve to be moved to its open position.

6. An exhaust gas recirculation system as claimed in claim 3, in which said control apparatus further comprises means for maintaining the regulated pressure.

7. An exhaust gas recirculation system as claimed in claim 4, in which said control apparatus further comprises: a feed back chamber communicating with the pressure responsive regulator valve to receive an output pressure regulated by said pressure responsive regulator valve, a feed back diaphragm defining a wall of said feed back chamber, said feed back diaphragm being connected to said pressure responsive regulator valve such that said pressure responsive regulator valve is actuated in such a direction as to reduce the output pressure provided by said pressure responsive regulator valve.

* * * * *